US007690286B2

(12) United States Patent
Suda

(10) Patent No.: US 7,690,286 B2
(45) Date of Patent: Apr. 6, 2010

(54) PIERCING DEVICE

(75) Inventor: Nobuyuki Suda, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 87 days.

(21) Appl. No.: 10/578,510

(22) PCT Filed: Nov. 1, 2004

(86) PCT No.: PCT/JP2004/016240

§ 371 (c)(1),
(2), (4) Date: May 8, 2006

(87) PCT Pub. No.: WO2005/044527

PCT Pub. Date: May 19, 2005

(65) Prior Publication Data

US 2007/0084540 A1 Apr. 19, 2007

(30) Foreign Application Priority Data

Nov. 11, 2003 (JP) ..... 2003-381097

(51) Int. Cl.
*B26F 1/24* (2006.01)

(52) U.S. Cl. ..... 83/337; 83/660

(58) Field of Classification Search ..... 83/331, 83/337, 339, 355, 669, 866, 867, 660
See application file for complete search history.

(56) References Cited

U.S. PATENT DOCUMENTS 2,088,118 A * 7/1937 Schillo ..... 83/117
3,369,435 A * 2/1968 Boultinghouse ..... 83/30
3,747,447 A * 7/1973 Wisner ..... 83/867

FOREIGN PATENT DOCUMENTS

JP A 48-8368 2/1973
JP 50-29752 B2 9/1975

* cited by examiner

*Primary Examiner*—Stephen Choi
(74) *Attorney, Agent, or Firm*—Oliff & Berridge, PLC

(57) ABSTRACT

A piercing device includes an outer tube rotatably supported on a first shaft and eccentrically arranged relative to a second shaft, so as to be driven for rotation. Piercing needles are arranged on the second shaft, spaced from each other in a circumferential direction, projecting radially outwards, rotatable about a second axis, and extendable and retractable relative to an outer surface via holes in the outer tube. A needle restraining member, rotatably supported on the second shaft, transmits torque to the piercing needles when driven for rotation. The first plurality of needles rotate in unison, as do the second plurality of needles and are fixedly connected to support members; thus, protecting the needles from unreasonable force and preventing undesirable enlargement of pinholes and deformation of the rubber sheet. Further, when the needles are advanced into the rubber sheet and retraced therefrom, enlargement of the rubber sheet pinholes can be prevented.

4 Claims, 7 Drawing Sheets

PIERCING DEVICE

FIELD OF THE INVENTION

The present invention relates to a piercing device that is used for piercing a number of pinholes in a rubber sheet for sufficiently extracting air or the like liable to be captured the rubber sheet as a tire constitutive members in the form of embedding reinforcement cords therein, such as carcass ply materials, belt ply materials, etc., or captured between laminated layers upon building of green tires. In particular, the present invention provides a technology capable of effectively preventing the piercing needles from being acted by an unreasonable force, undesired enlargement of the pinholes and deformation of the rubber sheet, etc.

RELATED ART

Such type of conventional piercing device for forming pinholes in a rubber sheet without the risk of breakage of the piercing needles is disclosed, for example, in Patent Document 1 identified below. In this instance, as shown in cross-section in FIG. 7, the piercing device 90 includes an outer tube 91 and an inner tube 92 which are rotatable about the respective stationary shafts 94, 95 which, in turn, are eccentrically arranged relative to each other with an eccentricity of δ. The inner tube 92 is provided with piercing needles 93 which can be freely extended and retracted through needle holes 96 formed in the outer tube 91.

By this, with the outer tube 91 urged against a traveling rubber sheet S, the outer tube 91 and the inner tube 92 are eccentrically rotated on the stationary shafts so as to pierce the rubber sheet S by the piercing needles 93, and smoothly retract the piercing needles after their working through the needle holes 96 into the outer tube 91.

Patent Document 1: JP 50-29752B2

DISCLOSURE OF THE INVENTION

With this known device, however, it is necessary for the piercing needles 93, which are pierced into the rubber sheet S wound about the outer tube 91, to be moved relatively to the rubber sheet S in its traveling direction, thereby giving rise to a problem of undesired expansion of the pinholes formed in the rubber sheet, deformation of the rubber sheet, etc. The reason for causing such relative movement will be explained below. Assuming that the outer peripheral surface of the outer tube 91 has a radius r, and the rubber sheet S would on the outer tube 91 is moved in the direction of the arrow in FIG. 7 with a constant linear speed v, the surface speed of the outer tube 91 is also v so that the rotational speed of the outer tube 91 is v/r.

The piercing needle 93 begins to pierce into the rubber sheet S at the winding starting point A of the rubber sheet S. At this starting point A, in order to prevent relative movement between the piercing needle 93 and the rubber sheet S, since the rotating radius of the piercing needle 93 at the starting point A up to the inner peripheral surface of the rubber sheet is substantially r, it is necessary for the inner tube 92 to have a rotating speed of v/r, which is the same as the rotating speed of the outer tube 91. On the other hand, at an intermediate position B where the outer tube 91 has been rotated by 90°, in order to prevent relative movement between the piercing needle 93 and the rubber sheet S, since the rotating radius of the piercing needle 93 at the intermediate point B up to the inner peripheral surface of the rubber sheet is (r-δ), it is necessary for the inner tube 92 to have a rotating speed of v/(r-δ).

If the inner tube 92 is provided with a single piercing needle 93 only, it is possible to prevent relative movement between the piercing needle 93 and the rubber sheet S by controlling the rotating speed of the inner tube 92 depending upon its rotating position. However, in the conventional device 90, all the piercing needles arranged at a predetermined distance in the circumferential direction are integrally provided on the inner tube 92, the rotating speeds of the piercing needles at different rotating positions must be the same with each other. Thus, the inner tube must be rotated one turn as the outer tube is rotated by one turn, with a substantially constant rotating speed. Therefore, particularly at a position adjacent to the above-mentioned intermediate position B, the relative movement between the piercing needle 93 and the rubber sheet S becomes marked, thereby making it impossible to prevent undesired enlargement of the pinholes formed by the piercing needles.

The present invention has been accomplished in view of these problems, and it is an object of the present invention is to provide a piercing device capable of effectively preventing the piercing needles from being acted by unreasonable force, undesired enlargement of the pinholes and deformation of the rubber sheet S, while ensuring that the pinholes formed in the rubber sheet S are prevented from enlargement even upon advancement and removal of the piercing needles into and from the rubber sheet.

(1) A first aspect of the present invention resides in a piercing device wherein an outer tube is rotatably supported on first shaft which is eccentrically arranged relative to a second shaft, so that it can be driven for rotation, wherein a plurality of piercing needles are arranged on the second shaft in said outer tube, the plurality of piercing needles being spaced from each other in a circumferential direction, and projecting radially outwards, and being independently rotatable, the piercing needles being adapted to be extended and retracted relative to an outer surface of the outer tube, via a through hole formed in the outer tube, wherein a needle restraining member is rotatably supported on the second shaft, for transmitting torque to the piercing needles when driven for rotation, wherein the piercing needles are rotatably supported on the second shaft via needle support members, respectively, and wherein the piercing needles which are rotatable integrally with each other, are fixedly connected to the needle support members in an axial juxtaposition with each other.

(2) A second aspect of the present invention resides in the piercing device according to the first aspect, wherein the outer tube and the needle support members are connected to a driving means for driving them at a constant speed (3) A third aspect of the present invention resides in the piercing device according to the first or second aspect, wherein a rotating radius of the outer surface of the outer tube and a rotating radius of a tip end of each of the piercing needles are the same with respect to each other, and an amount of eccentricity of said shafts is within a range of 10-15 mm.

With the features (1) according to the first aspect of the present invention, the plurality of piercing needles projecting radially outwards at a distance in the circumferential direction are arranged so that they can be independently rotated relative to each other, and each piercing needle can be moved outwards and inwards relative to the surface of the outer tube via a through hole formed in the outer tube. Therefore, after the piercing needle has been advanced into the rubber sheet, the piercing needle is driven by the rubber sheet so as to undergo a free rotation without being acted by any additional restraining force, so as to effectively prevent the piercing needles from being acted by unreasonable force, undesired enlargement of the pinholes and deformation of the rubber sheet. Moreover, each of the piercing needles are rotatably supported on the second shaft via needle support members, respectively, and the piercing needles and further piercing needles which are rotatable integrally with the said piercing needles are fixedly connected to the needle support members in an axial juxtaposition with each other. Thus, when three or more piercing needles are arranged in juxtaposition relative to each other, these piercing needles can be collectively secured to the needle support member and the needle support member can be rotatably supported at two locations in the axial direction so as to reduce the length required for axially arranging the bearings as compared to the case wherein each piercing needle is individually supported by one bearing, thereby making it possible to arrange an increased number of piercing needles in the axial direction.

With the feature (2) according to the second aspect of the present invention, since the outer tube and the needle support members are connected to a driving means for driving them at a constant speed, it is possible to conform the average peripheral speed of feeding the rubber sheet with the average peripheral speed of advancing the piercing needles, so as to stably perform piercing into the rubber sheet by the piercing needles without applying undesired force.

With the feature (3) according to the third aspect of the present invention, since the rotating radius of the outer surface of the outer tube and the rotating radius of the tip end of each piercing needle are the same with each other, the piercing needles can be advanced into the rubber sheet and removed therefrom substantially at right angles relative to the rubber sheet. Moreover, since the amount of eccentricity of the shafts is within a range of 10-15 mm, the rubber sheet can be positively formed with pinholes without enlarging them.

DETAILED DESCRIPTION OF EMBODIMENTS

Figure 1:
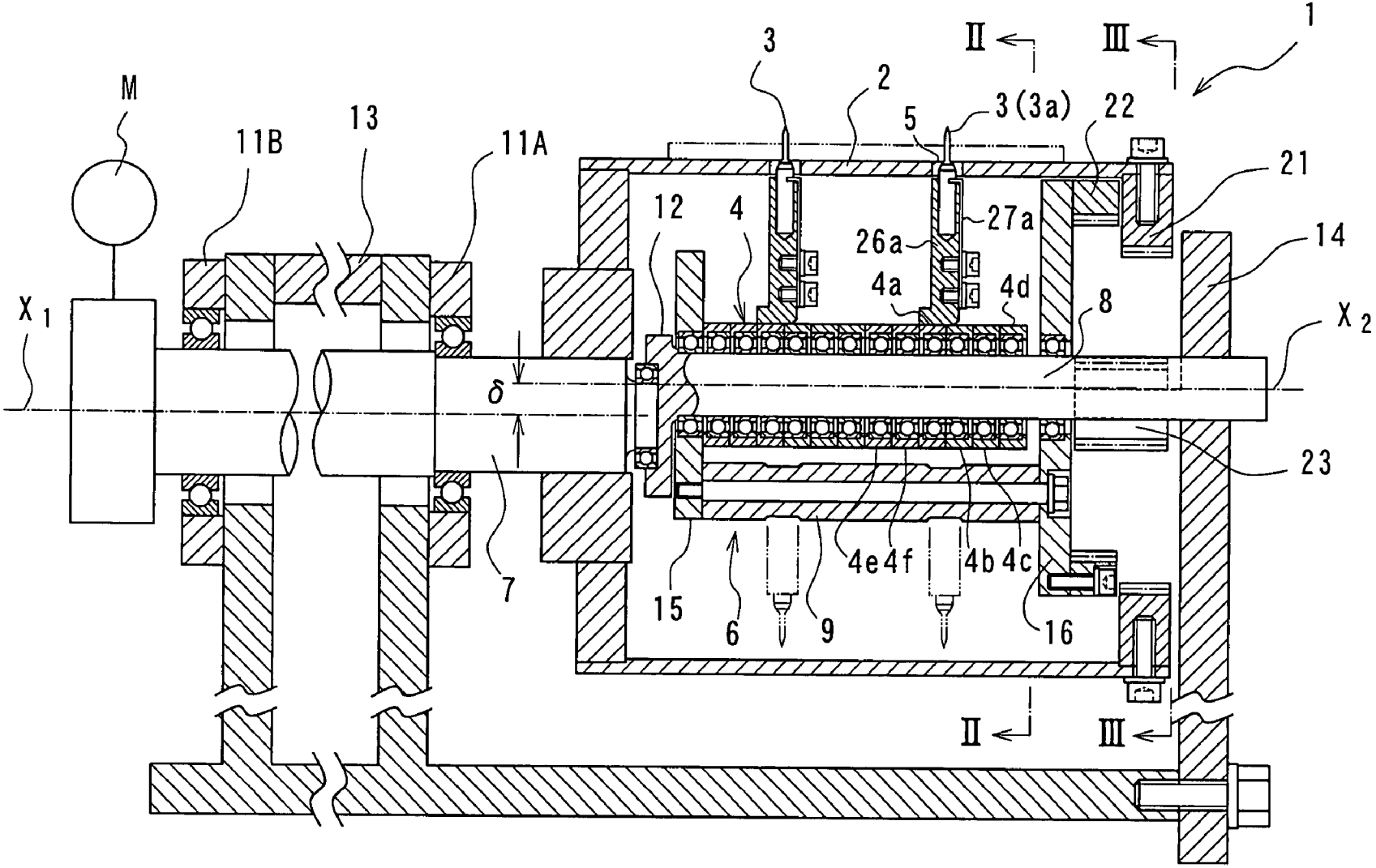
FIG. 1 is a sectional view of the piercing device, showing the basic concept of the present invention.
Figure 2:
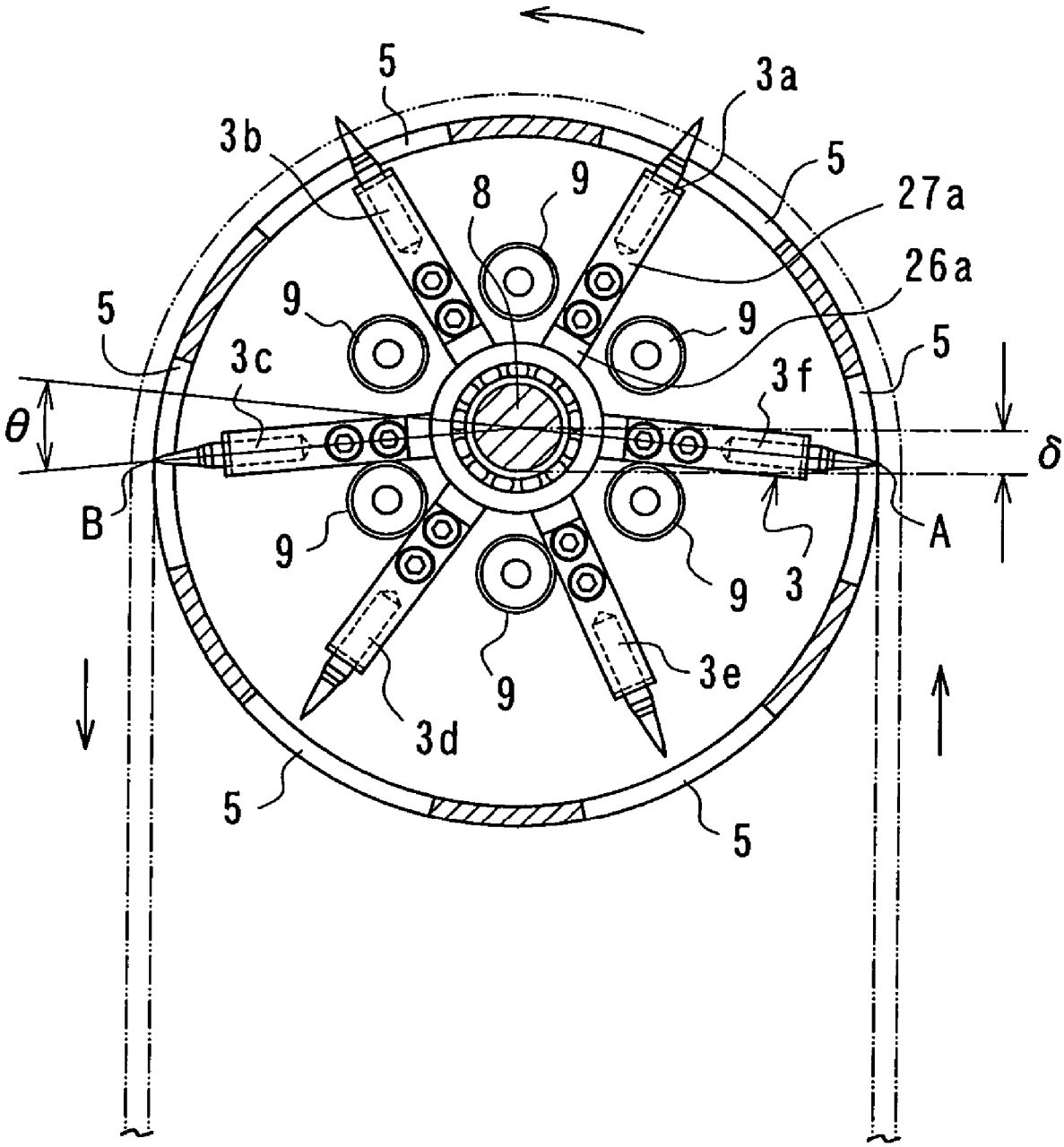
FIG. 2 is a sectional view of the piercing device taken along the line II-II in FIG. 1.
Figure 3:
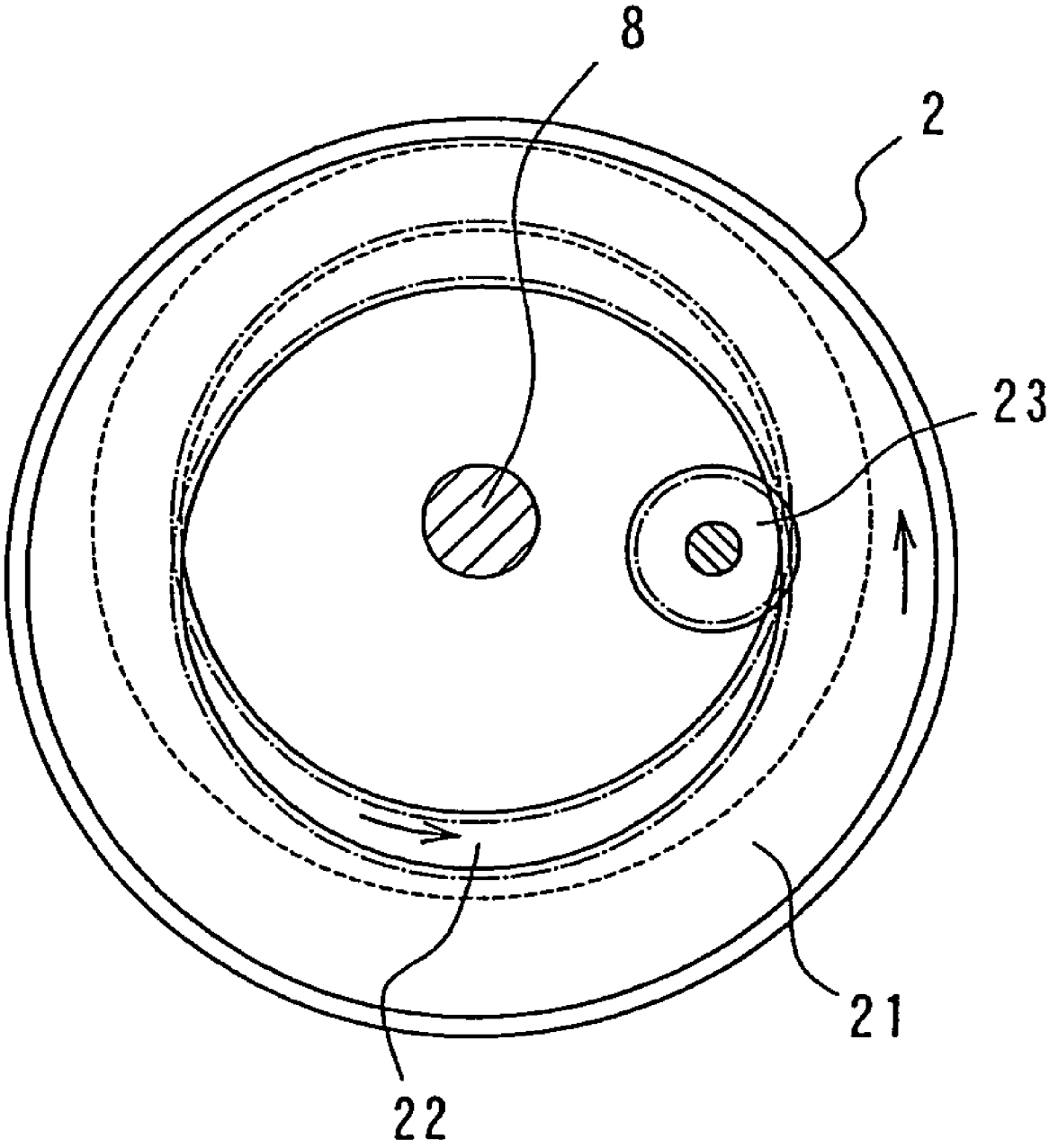
FIG. 3 is a sectional view of the piercing device taken along the line III-III in FIG. 1.

The basic concept of the present invention will be explained below with reference to the drawings, wherein FIG. 1 is a sectional view of the piercing device 1, showing the basic concept of the present invention, FIG. 2 is a sectional view of the piercing device taken along the line II-II in FIG. 1, and FIG. 3 is a sectional view of the piercing device taken along the line III-III in FIG. 1. The piercing device 1 comprises an outer tube 2 which is integrally connected to a rotatable shaft 7 supported by bearings 11A, 11B and adapted to be driven by a motor M, and a plurality of piercing needles 3 which are rotatably provided for a stationary shaft 8 and arranged to project radially outwards at an interval in the circumferential direction. Here, the rotatable shaft 7 constitutes the first shaft having an axis X1, and the stationary shaft 8 constitutes the second shaft having an axis X2, wherein the axes X1, X2 are eccentrically arranged by an eccentricity δ.

The bearings 11A, 11B are fixedly secured to a stay 13, and the stationary shaft 8 has a base end which is fixedly secured to a stay 14, and a free end that is supported by the rotatable shaft 7 via a bearing member 12. The stays 13, 14 are integrally connected to each other so that the bearings 11A, 11B, the stationary shaft 8, the stays 13, 14 and the bearing member 12 are all provided in integrated manner.

In the illustrated embodiment, the piercing needles 3 are arranged in two rows in the axial direction, with each row including six needles which are arranged in the circumferential direction. Thus, there are twelve needles in total. The piercing needles 3 in each row are connected to the respective bearings 4 (4*a*-4*f*) with a one-to-one relationship, wherein these bearings are independently rotatable. Thus, with reference to the row illustrated on the right side in FIG. 1, the piercing needle 3*a* is connected to the bearing 4*a*, the piercing needle 3*b* is connected to the bearing 4*b*, and the piercing needles 3*c*-3*f* are similarly connected to the respective bearings 4*c*-4*f*. The bearings 4*a*-4*f* are rotatable about the axis X2 independently of each other, so that the piercing needles 3*a*-3*f* are also rotatable about the axis X2 independently of each other.

Incidentally, as for the manner of securing the piercing needles 3 in place, for example, the needle 3*a* is inserted into a bore formed at the tip end of a needle support 26*a* which is secured to the bearing 4*a*. In order to position the piercing needle 3*a* in the radial direction, a needle positioning plate 27*a* is fixedly secured to the needle support 26*a*. The needle positioning plate 27*a* has a projection, which can be inserted into a cutout formed in the piercing needle 3*a*, so as to position the piercing needle 3*a*.

The outer tube 2 is provided with through holes 5 at locations corresponding to the piercing needles 3, so that the tip ends of the piercing needles 3 can be moved radially outwards and inwards relative to the surface of the outer tube 2, with the tip ends projecting outwards from the outer tube 2. Thus, for example, assuming that the radius of the outer tube 2 and the rotating radius of the tip end of the piercing needles 3 about the axis X2 are determined to be the same radius r, and further that the eccentricity δ between the axis X1 and the axis X2 is 10 mm, the maximum projection amount, in the radial direction, of the piercing needles 3 from the outer tube 2 is 10 mm.

Here, it is preferred that the radius of the outer tube 2 and the rotating radius of the tip end of the piercing needles 3 about the axis X2 are determined to be the same radius r, since the piercing needles 3 can be advanced into the rubber sheet S and removed therefrom substantially at right angles relative to the rubber sheet, while they are moving substantially at the same speed. From practical viewpoint, however, it is sufficient for these radii to be substantially the same; in other words, the rotating radius of the piercing needles 3 may be slightly larger or smaller than the radius of the outer tube 2, provided that the piercing needles 3 form pinholes in the rubber sheet S having a size within an acceptable range.

It is preferred for the maximum projection amount of the piercing needles 3 from the outer tube 2, to be within a range from 10 mm to 15 mm. If the maximum projection amount is below 10 mm, it is difficult to form pinholes in the rubber sheet since the piercing needles 3 advanced into the rubber sheet S merely stretch the rubber. If, on the other hand, the maximum projection amount exceeds 15 mm, the pinholes formed by the piercing needles become too large in size, giving rise to problems that other rubber materials may intrude into the pinholes, or that the cross-sectional shape of tires cannot be made as smooth as it should be.

The stationary shaft 8 having the other axis X2 serves to rotatably support a needle restraining member 6. The needle restraining member 6 is provided with guide bars 9 which are arranged at a constant interval in the circumferential direction. Each guide bar 9 extends in parallel with the axes X1, X2, and has its both ends fixedly secured to end plates 15, 16, respectively. An internal gear 22 is secured to the end plate 16 coaxially to the axis X2, while another internal gear 21 is secured to an axial end of the outer tube 2 coaxially to the axis X1. The internal gears 21, 22 are coupled with each other via an intermediate gear 23. The internal gears 21, 22 have the same number of gear teeth. Thus, the outer tube 2 and the needle restraining member 6 are rotatable completely synchronously with each other.

The piercing device 1 constructed as described above is operated in order to form pinholes in a cord-reinforced rubber sheet S which is wound around the outer tube. The mode of operation will be explained below. With reference to FIG. 2, when the outer tube 2 is driven for counterclockwise rotation, as shown by a curved arrow, the rubber sheet S wound on the outer peripheral surface of the outer tube 2 with a winding angle of 180° is also caused to travel in the directions of straight arrows, at the same speed as the surface speed of the outer tube 2. The piercing needle 3 which has reached the winding starting position A of the rubber sheet S begins to pierce into the rubber sheet S while being driven by the rubber sheet S to rotate about the axis X2. In this instance, except being driven by the rubber sheet S, the piercing needle 3 is not at all restrained, so that the rubber sheet S is positively prevented from being acted by any unnecessary forces.

With further reference to FIG. 2, when the piercing needle 3 passes the position immediately above the axis and reaches the winding terminating point B, the piercing needle 3 is removed from the rubber sheet S. During this course of movement, since the piercing needle 3 and the rubber sheet S are moved synchronously with each other, it is possible to prevent enlargement of the pinholes or deformation of the rubber sheet S. Incidentally, while the outer tube 2 is rotated between the starting point A and the terminating point B by an angle of 180°, since the rotating center X2 of the piercing needle 3 is eccentric to the axis X1 of the outer tube 2, the piercing needle is additionally rotated by an angle θ which corresponds to the eccentricity δ.

Furthermore, at the winding starting point A and the terminating point B of the rubber sheet S with respect to the outer tube 2, the piercing needle 3 can be advanced into the rubber sheet S and removed therefrom substantially at right angles to the rubber sheet. Therefore, it is possible to prevent the pinholes in the rubber sheet from undesired enlargement, upon advancement and removal of the piercing needle 3 relative to the rubber sheet S.

The piercing needle 3 removed from the rubber sheet S is applied with a rotating force by the guide bar 9 which rotates synchronously with the outer tube 2, and is thereby returned to the winding starting point A, where it begins to be advanced into the rubber sheet S once again so as to repeat the above-mentioned operations.

In the present invention, the arrangement or the number of the piercing needles is not limited to those explained above with reference to a specific embodiment. Also, the winding angle of the rubber sheet on the outer tube is not limited to 180°. The piercing device 1 can be applied to a rubber sheet in which the reinforcing cords are arranged at rights angles to the traveling direction of the rubber sheet S. However, the conventional device of this kind suffers from undesired enlargement of the pinholes in the traveling direction of the rubber sheet S, as explained above. Therefore, the piercing device 1 according to the present invention exhibits more marked advantage when applied to a rubber sheet without enforcing cords, or to a rubber sheet in which the reinforcement cords extend in the traveling direction of the rubber sheet S.

The driving device for traveling the rubber sheet S may be provided separately from the piercing device so that the outer tube 2 so that the outer tube 2 is rotated following the rubber sheet S. However, if the outer tube 2 is driven by the motor M, the piercing device 1 also has a function of driving the rubber sheet S as well to thereby save the space and cost.

In the above, the basic concept of the present invention has been described above with reference to an embodiment wherein the piercing needles 3 are provided in two rows. If, however, the piercing needles 3 of an increased number are to be arranged more closely, it would be necessary to increase the number of the bearings, though the number of bearings that can be arranged on the shaft in alignment with each other is limited by itself. Therefore, the present invention further provides an advanced embodiment of the piercing device that can be used in such a case also, which will be described below with reference to FIGS. 4 to 6.

Figure 4:
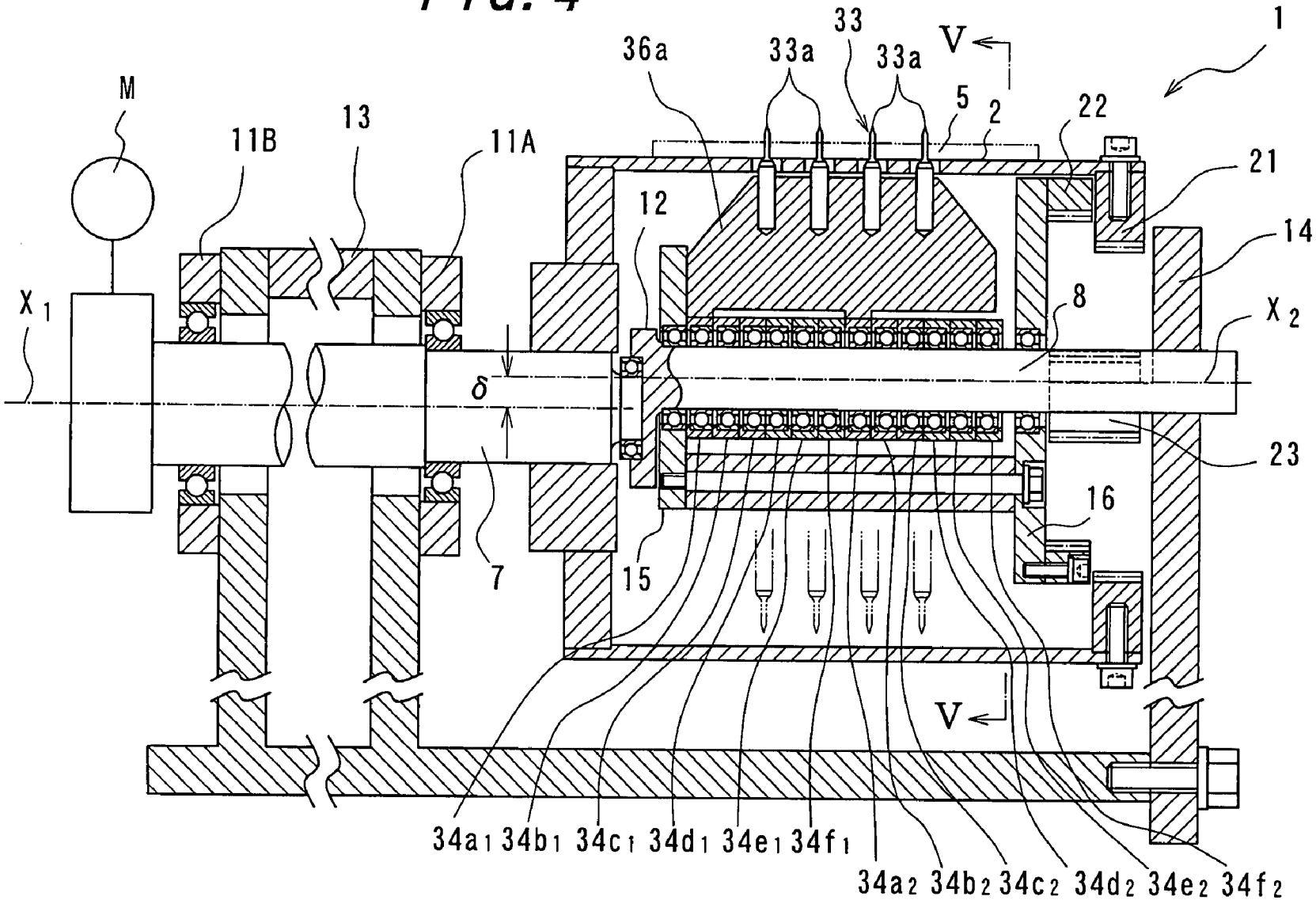
FIG. 4 is a sectional view of the piercing device according to another embodiment of the present invention.
Figure 5:
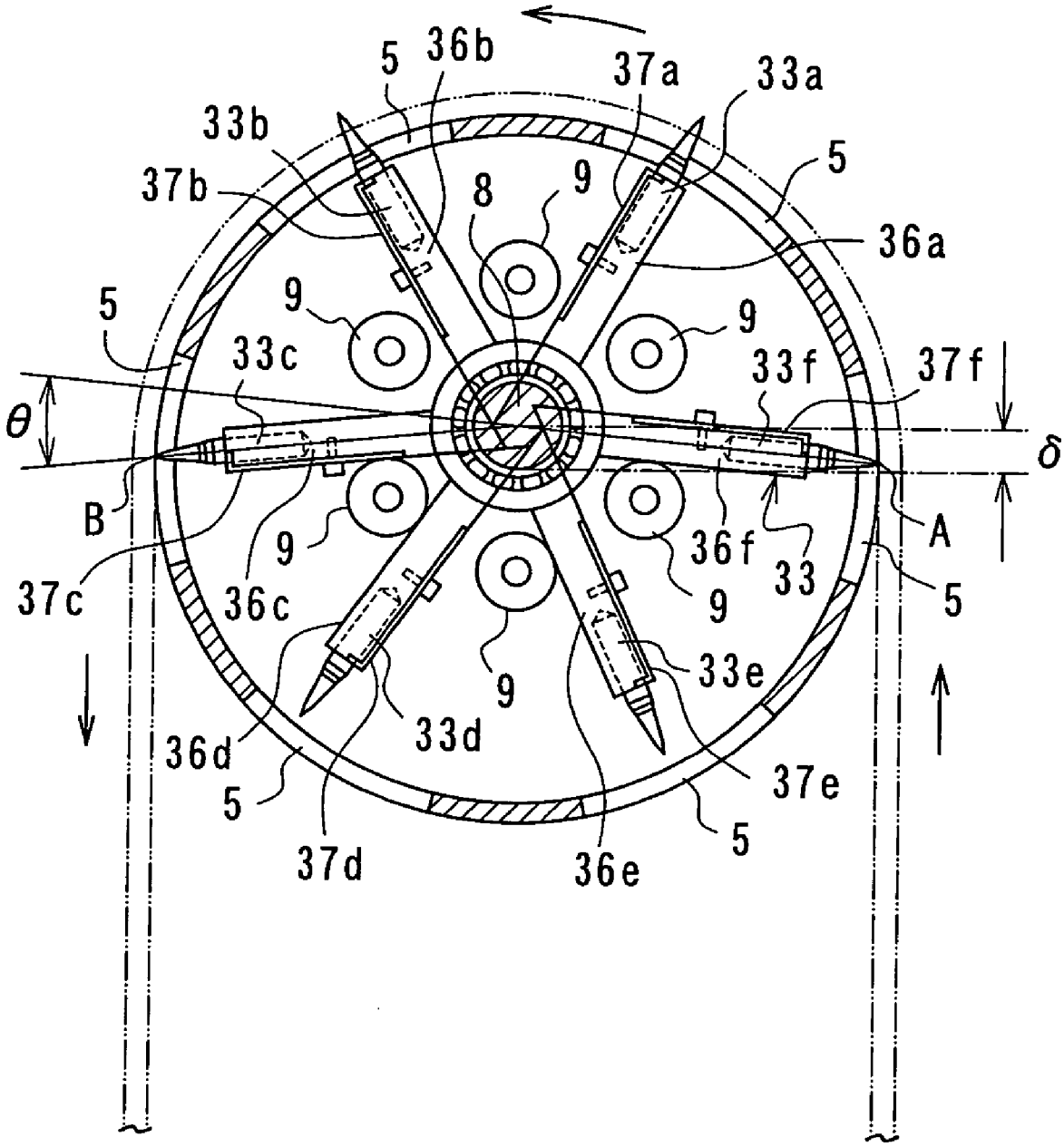
FIG. 5 is a sectional view of the piercing device taken along the line V-V in FIG. 4.
Figure 6:
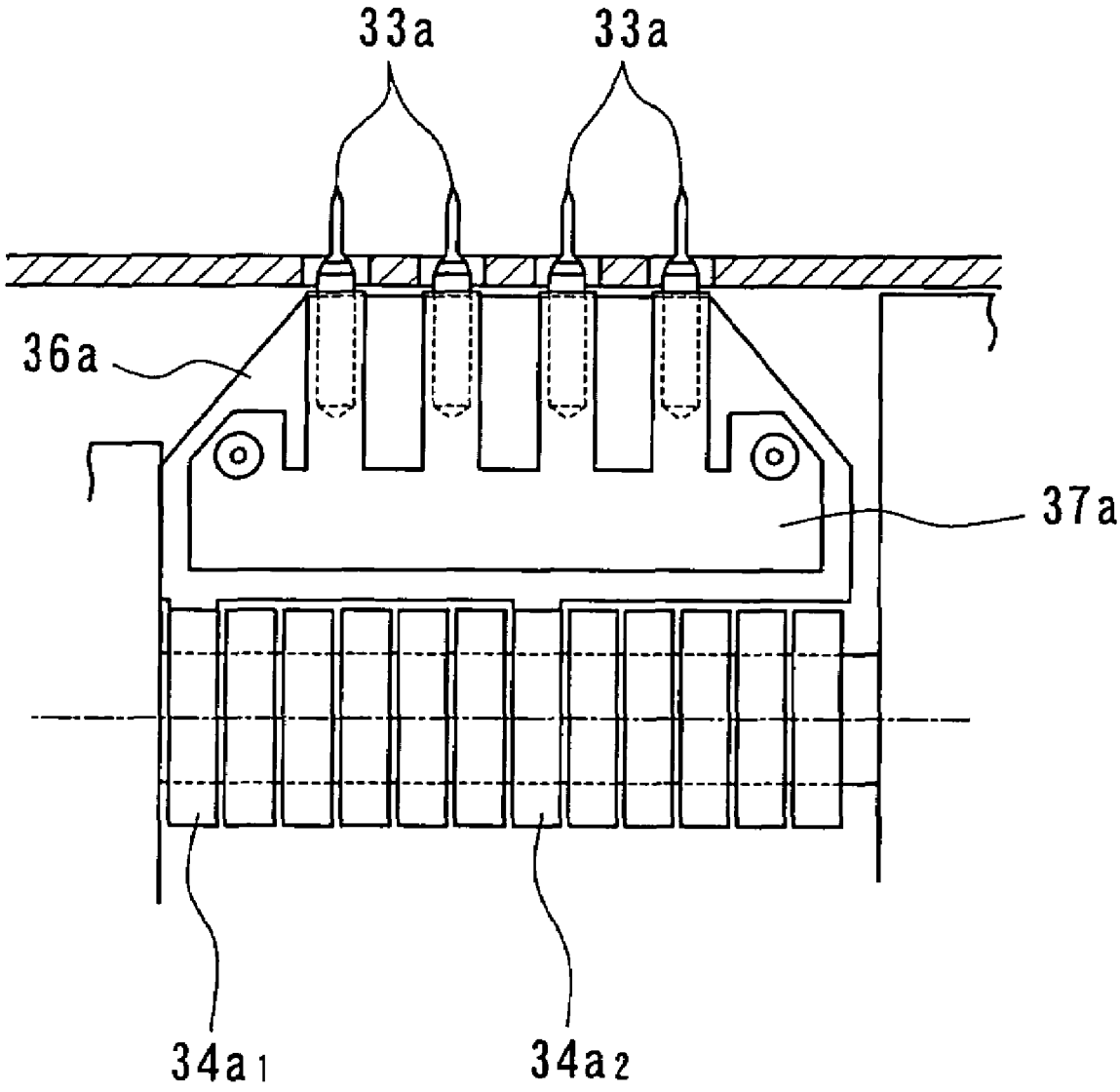
FIG. 6 is a front view showing the piercing needle supporting portion.
Figure 7:
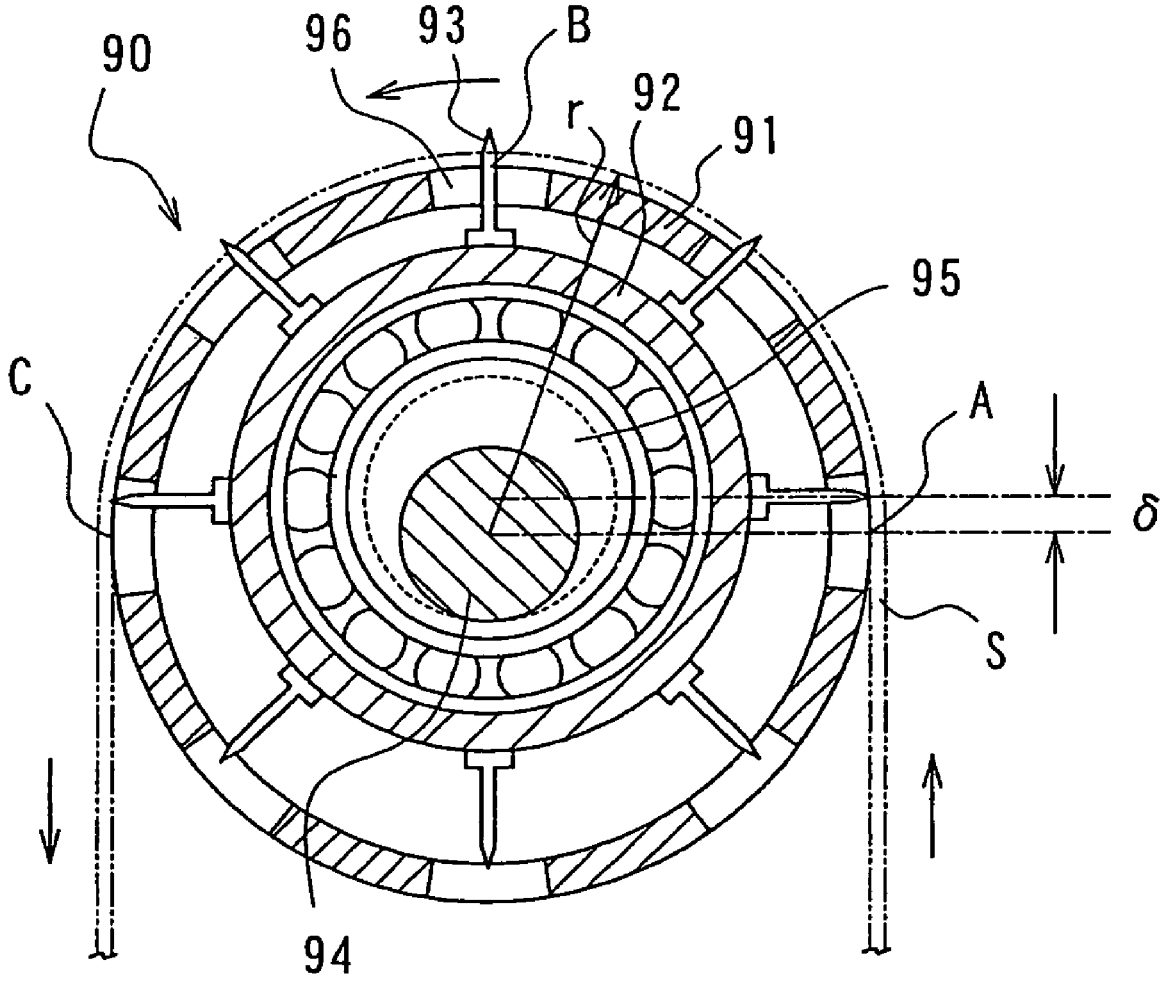
FIG. 7 RELATED ART
FIG. 7 is a sectional view showing the above-mentioned conventional piercing device.

FIG. 4 is a sectional view of the piercing device according to the advanced embodiment, FIG. 5 is a sectional view of the piercing device taken along the line V-V in FIG. 4, and FIG. 6 is a front view showing the piercing needle supporting portion. The elements shown in these figures are essentially the same as the corresponding elements shown in FIGS. 1 to 3, except the portion for securing the piercing needles to the bearings. Thus, those corresponding elements are denoted by the same reference numerals to eliminate superfluous description.

In the advanced embodiment illustrated, four piercing needles 33 (e.g., the piercing needle 33*a*) are juxtaposed in the axial direction, and secured to a radially outer edge of a needle supporting plate 36*a*. Six such needle supporting plates 36*a* to 36*f* are arranged in the circumferential direction. Thus, there are twenty four piercing needles in total. Twelve bearings 34*a*1 to 34*f*1 and 34*a*2 to 34*f*2 are arranged on the axis X2, which are independently rotatable about the axis X2.

The needle supporting plates 36*a* to 36*f* for the piercing needles 33 serve as the piercing needle supporting members. The piercing needles 33 have a relative degree of freedom such that six piercing needles consisting of one needle selected from the needles of each needle supporting plate 36*a* to 36*f* are arranged so as to be rotated independently of the other, and the other needles 33 among the needles 33 secured to each needle supporting plate 36*a* to 36*f* is arranged so as to be rotated integrally with the selected one of the piercing needles 33.

The needle supporting plate 36*a* is secured to a pair of the bearings 34*a*1, 34*a*2, the needle supporting plate 36*b* is secured to a pair of the bearings 34*b*1, 34*b*2, and the needle supporting plates 36*c*, 36*d*, 36*e* and 36*f* are similarly secured to the respective pairs of the bearings 34*c*1, 34*c*2; 34*d*1, 34*d*2; 34*e*1, 34*e*2; and 34*f*1, 34*f*2. Since the twelve bearings 34*a*1 to 34*f*1 and 34*a*2 to 34*f*2 can be independently rotated, the needle supporting plates 36*a* to 36*f* and, hence, the circumferentially arranged piercing needles 33*a* to 33*f* can also be independently rotated.

As for the manner of securing the piercing needles 33 in place, for example, the needle 33*a* is inserted into a bore formed at the tip end of the needle supporting plate 36*a*. In order to position the piercing needle 33*a* in the radial direction, a needle positioning plate 37*a* is fixedly secured to the needle supporting plate 36*a*. The needle positioning plate 37*a* has a projection, which can be inserted into a cutout formed in the piercing needle 33*a*, so as to position the piercing needle 33*a*.

With the structure of the advanced embodiment described above, the piercing needles 33*a* to 33*f* can be operated in the same manner as in the previously explained basic embodiment so as to provide essentially the same functions. Moreover, as compared with the basic embodiment, the advanced embodiment makes it possible to arrange an increased number of the piercing needles.

The invention claimed is:

1. A piercing device comprising:

a first shaft having a first axis;

a second shaft having a second axis, the second axis being eccentrically arranged relative to the first axis;

an outer tube rotatably supported on the first shaft so that the outer tube can be driven for rotation;

a plurality of needle support members that are independently rotatably supported on the second shaft and successively arranged along the second axis;

a plurality of piercing needles arranged in a circumferential direction and supported on the second shaft via the needle support members, said plurality of piercing needles being spaced from each other in a circumferential direction, projecting radially outwards, and being each movable toward and away from other piercing needles in the circumferential direction, the piercing needles each being extendable and retractable relative to an outer surface of the outer tube via holes formed in the outer tube;

a needle restraining member rotatably supported on the second shaft, for transmitting torque to the piercing needles when driven for rotation; and a plurality of guide bars that stop rotation of one or more of the plurality of piercing needles, one of the plurality of guide bars being positioned between two adjacent piercing needles, and disposed between the tip of one of the two adjacent piercing needles and the second axis.

2. The piercing device according to claim 1, wherein the outer tube and the needle support members are connected to a driving means for driving them at a constant speed.

3. The piercing device according to claim 1, wherein a rotating radius of the outer surface of the outer tube and a rotating radius of a tip end of the plurality of piercing needles are the same with respect to each other, and an amount of eccentricity of the first and second shafts is within a range of 10-15 mm.

4. The piercing device according to claim 2, wherein a rotating radius of the outer surface of the outer tube and a rotating radius of a tip end of the plurality of piercing needles are the same with respect to each other, and an amount of eccentricity of the first and second shafts is within a range of 10-15 mm.

* * * * *